US011024952B1

(12) United States Patent
Quarfoth et al.

(10) Patent No.: US 11,024,952 B1
(45) Date of Patent: Jun. 1, 2021

(54) BROADBAND DUAL POLARIZATION ACTIVE ARTIFICIAL MAGNETIC CONDUCTOR

(71) Applicant: HRL Laboratories, LLC, Malibu, CA (US)

(72) Inventors: Ryan G. Quarfoth, Los Angeles, CA (US); Carson R. White, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 16/258,501

(22) Filed: Jan. 25, 2019

(51) Int. Cl.

| | |
|---|---|
| ***H01Q 21/06*** | (2006.01) |
| ***H01Q 1/36*** | (2006.01) |
| ***H01Q 9/16*** | (2006.01) |
| ***H01Q 1/52*** | (2006.01) |
| ***H01Q 1/48*** | (2006.01) |

(52) U.S. Cl.
CPC ..... *H01Q 1/364* (2013.01); *H01Q 1/48* (2013.01); *H01Q 1/523* (2013.01); *H01Q 9/16* (2013.01); *H01Q 21/065* (2013.01)

(58) Field of Classification Search
CPC ..... H01Q 1/36; H01Q 1/364; H01Q 1/38; H01Q 1/52; H01Q 1/521; H01Q 1/523; H01Q 21/06; H01Q 21/061; H01Q 21/065; H01Q 21/08; H01Q 21/29
See application file for complete search history.

(56) References Cited

U.S. PATENT DOCUMENTS

| | | | |
|---|---|---|---|
| 4,234,960 | A | 11/1980 | Spilsbury |
| 4,242,685 | A | 12/1980 | Sanford |
| 4,803,494 | A | 2/1989 | Norris et al. |
| 4,904,952 | A | 2/1990 | Tanimoto |
| 4,916,457 | A | 4/1990 | Foy et al. |
| 5,311,198 | A | 5/1994 | Sutton |
| 5,392,002 | A | 2/1995 | Delano |
| 5,489,878 | A | 2/1996 | Gilbert |
| 6,081,167 | A | 6/2000 | Kromat |
| 6,121,940 | A | 9/2000 | Skahill et al. |
| 6,304,226 | B1 | 10/2001 | Brown et al. |

(Continued)

FOREIGN PATENT DOCUMENTS

| | | |
|---|---|---|
| CN | 101853974 | 10/2010 |
| CN | 102005648 | 4/2011 |

(Continued)

OTHER PUBLICATIONS

U.S. Appl. No. 14/856,541, filed Sep. 16, 2015, Daniel J. Gregoire.

(Continued)

*Primary Examiner* — Jason Crawford
(74) *Attorney, Agent, or Firm* — Ladas & Parry

(57) ABSTRACT

A system and method for a dual-polarized active artificial magnetic conductor (AAMC) is presented in this disclosure. An embodiment of the proposed system comprises an array of unit cells that reflects electromagnetic waves polarized parallel to a surface with a zero-degree phase shift. The array of unit cells has impedance elements connected to neighboring impedance elements with non-Foster circuits coupled in a crossover configuration, each impedance element being coupled to a ground with a conductive via.

33 Claims, 8 Drawing Sheets

(56) References Cited

U.S. PATENT DOCUMENTS 6,411,261 B1 6/2002 Lilly
6,476,771 B1 11/2002 McKinzie
6,483,480 B1 11/2002 Sievenpiper et al.
6,509,875 B1 1/2003 Nair et al.
6,512,494 B1 * 1/2003 Diaz ..... H01Q 7/00 343/842
6,518,930 B2 2/2003 Itoh et al.
6,525,695 B2 2/2003 McKinzie, III
6,538,621 B1 * 3/2003 Sievenpiper ..... H01Q 9/0442 343/700 MS
6,768,472 B2 7/2004 Alexopoulos et al.
6,917,343 B2 7/2005 Sanchez
6,952,565 B1 10/2005 Takeda
7,042,419 B2 5/2006 Werner et al.
7,245,269 B2 7/2007 Sievenpiper
7,388,186 B2 6/2008 Berg et al.
7,429,961 B2 9/2008 Sievenpiper et al.
7,586,384 B2 9/2009 Ranta
7,619,568 B2 11/2009 Gillette
7,847,633 B2 12/2010 Kinget
7,852,174 B2 12/2010 Cathelin
7,880,568 B2 2/2011 Amin et al.
7,941,022 B1 5/2011 Schaffner et al.
8,111,111 B2 2/2012 Van Bezooijen
8,263,939 B2 9/2012 Delaney et al.
8,283,553 B1 10/2012 Yap et al.
8,358,989 B2 1/2013 Kakuya et al.
8,374,561 B1 2/2013 Yung
8,436,785 B1 5/2013 Lai et al.
8,451,189 B1 5/2013 Fluhler
8,471,776 B2 6/2013 Das
8,639,203 B2 1/2014 Robert et al.
8,957,831 B1 * 2/2015 Gregoire ..... H01Q 15/004 343/909
8,959,831 B2 2/2015 Smith
8,988,173 B2 3/2015 Hitko et al.
8,976,077 B2 4/2015 Colburn et al.
9,093,753 B2 7/2015 Jung
9,379,448 B2 * 6/2016 Gregoire ..... H01Q 15/141
9,425,769 B1 8/2016 White et al.
9,705,201 B2 7/2017 White et al.
10,103,445 B1 10/2018 Gregoire et al.
10,193,233 B1 * 1/2019 Gregoire ..... H01Q 15/14
10,739,437 B2 * 8/2020 Toyao ..... H01Q 15/0066
2001/0050641 A1 12/2001 Itoh et al.
2002/0041205 A1 4/2002 Oppelt
2002/0167456 A1 * 11/2002 McKinzie, III ..... H01Q 15/008 343/909
2002/0167457 A1 * 11/2002 McKinzie, III ..... H01Q 15/008 343/909
2003/0020655 A1 1/2003 McKinzie
2003/0071763 A1 4/2003 McKinzie, et al.
2003/0076274 A1 * 4/2003 Phelan ..... H01Q 3/26 343/895
2003/0112186 A1 * 6/2003 Sanchez ..... H01Q 9/27 343/700 MS
2004/0056814 A1 3/2004 Park et al.
2004/0227667 A1 11/2004 Sievenpiper
2004/0227668 A1 * 11/2004 Sievenpiper ..... H01Q 23/00 343/700 MS
2004/0263420 A1 * 12/2004 Werner ..... H01Q 17/00 343/909
2005/0146475 A1 7/2005 Bettner
2005/0184922 A1 8/2005 Ida et al.
2006/0017651 A1 1/2006 Werner et al.
2007/0182639 A1 * 8/2007 Sievenpiper ..... H01Q 15/008 343/700 MS
2008/0088390 A1 4/2008 Cathelin
2008/0094300 A1 4/2008 Lee
2008/0164955 A1 7/2008 Pfeiffer
2008/0169992 A1 7/2008 Ortiz et al.
2008/0242237 A1 10/2008 Rofougaran et al.
2008/0284674 A1 * 11/2008 Herz ..... H01Q 21/29 343/909
2009/0025973 A1 1/2009 Kazantsev et al.
2009/0109121 A1 * 4/2009 Herz ..... H01Q 15/0066 343/912
2010/0039111 A1 2/2010 Luekeke et al.
2010/0039343 A1 2/2010 Uno et al.
2010/0149430 A1 6/2010 Fulga et al.
2010/0225395 A1 9/2010 Patterson
2010/0231470 A1 9/2010 Lee et al.
2010/0238085 A1 9/2010 Fuh et al.
2011/0018649 A1 1/2011 David et al.
2011/0090128 A1 4/2011 Sulima et al.
2011/0115584 A1 5/2011 Kiji
2012/0256709 A1 10/2012 Hitko et al.
2012/0256811 A1 * 10/2012 Colburn ..... H01Q 15/0066 343/907
2012/0287006 A1 11/2012 Lenormand et al.
2013/0009720 A1 1/2013 White et al.
2013/0009722 A1 1/2013 White et al.
2013/0170020 A1 7/2013 Davis
2013/0200947 A1 * 8/2013 Alexopoulos ..... H01Q 15/0006 327/560
2013/0268250 A1 10/2013 Werner et al.
2015/0244079 A1 * 8/2015 White ..... H01Q 15/0086 343/913
2015/0244080 A1 8/2015 Gregoire et al.
2015/0263432 A1 * 9/2015 White ..... H01Q 15/002 343/913

FOREIGN PATENT DOCUMENTS

EP 0295704 12/1988
EP 2290745 3/2011
GB 2288502 10/1995
JP 2008278159 11/2008
TW 200845482 11/2008
WO 2004/013933 2/2004
WO 2006/054246 5/2006
WO 2009/090244 7/2009
WO PCT/US12/32638 4/2012
WO PCT/US12/32648 4/2012
WO 2012/139071 10/2012
WO 2012/139079 10/2012
WO PCT/US14/72233 12/2014
WO 2015/126521 8/2015

OTHER PUBLICATIONS

U.S. Appl. No. 61/473,076, filed Apr. 7, 2011, Joseph S. Colburn et al.

Gregoire, D.; White, C.; Colburn J., "Wideband Artificial Magnetic Conductors Loaded with Non-Foster Negative Inductors," Antennas and Wireless Propagation Letters, IEEE , vol. 10, 1586-1589, 2011.

D. Sievenpiper, L. Zhang, R. Broas, N. Alexopolous, and E. Yablonovitch, "High-impedance Electromagnetic Surfaces with a Forbidden Frequency Band," IEEE Transactions on Microwave Theory and Techniques, vol. 47, No. 11, pp. 2059-2074, Nov. 1999.

F. Costa, S. Genovesi, and A. Monorchio, "On the Bandwidth of High-Impedance Frequency Selective Surfaces", IEEE Antennas and Wireless Propagation Letters, vol. 8, pp. 1341-1344, 2009.

D. J. Kern, D. H. Werner and M. H. Wilhelm, "Active Negative Impedance Loaded EBG Structures for the Realization of Ultra-Wideband Artificial Magnetic Conductors," Proc. IEEE Ant. Prop. Int. Symp., vol. 2, 2003, pp. 427-430.

White, C. R.; May, J. W.; Colburn, J. S., "A Variable Negative-Inductance Integrated Circuit at UHF Frequencies," IEEE Microwave and Wireless Components Letters, vol. 21, No. 1, 35-37, 2012.

O. Luukkonen et al, "Simple and Accurate Analytical Model of Planar Grids and High-Impedance Surfaces", IEEE Transactions an Antennas Propagation, vol. 56, No. 6, pp. 1624-1632, 2008.

R. M. Foster., "A Reactance Theorem", Bell Systems Technical Journal, vol. 3, pp. 259-267, 1924.

Gregoire, D. J.; Colburn, J. S.; White, C. R., "A Coaxial TEM Cell for Direct Measurement of UHF Artificial Magnetic Conductors", IEEE Antennas and Propagation Magazine, vol. 54, No. 2, pp. 251-250, 2012.

(56) References Cited

OTHER PUBLICATIONS

Stearns, "Non-Foster Circuits and Stability Theory," Proc. IEEE Ant. Prop. Int. Symp., 2011, pp. 1942-1945.
S. E. Sussman-Fort and R. M. Rudish. "Non-Foster Impedance Matching of Electrically-Small Antennas," IEEE Transactions on Antennas and Propagation, vol. 57, No. 8, pp. 2230-2241, Aug. 2009.
C. R. White and G. M. Rebeiz, "A Shallow Varactor-Tuned Cavity-Backed Slot Antenna with a 1.9:1 Tuning Range," IEEE Transactions on Antennas and Propagation, vol. 58, No. 3, pp. 633-639, 2010.
From Chinese Patent Application No. 201280033448.2, PRC Office Action dated Nov. 17, 2015 with Brief English summary.
From U.S. Appl. No. 13/472,396, Non Final Rejection dated Sep. 11, 2015.
From Chinese Patent Application No. 201280021746.X, PRC Office Action dated Jul. 22, 2015 with brief English summary.
From Chinese Patent Application No. 201280033448.2, PRC Office Action dated Jun. 8, 2015 with machine English translation.
Pozar, David M., Microwave Engineering, Second Edition, John Wiley & Sons, Inc., 1998, pp. 89-90 and pp. 629-631 with table of contents (16 pages).
Sandel, B., Chapter 23, Radio Frequency Amplifiers, A.S.T.C., pp. 912-946, (1960).
From U.S. Appl. No. 13/472,396, Office Action dated Apr. 9, 2015.
EPO Extended Search Report with Search Opinion dated Mar. 19, 2015 from European Patent Application No. 12806913.5.
Mirzaei et al., "A Wideband Metamaterial-Inspired Compact Antenna Using Embedded Non-Foster Matching," 2011 IEEE International Symposium on Antennas and Propagation (APSURI), pp. 1950-1953, (2011).
Adonin, et al., "Monolith Optoelectronic Integrated Circuit With Built-In Photovoltaic Supply for Control and Monitoring," 1998 IEEE International Conference on Electronics, Circuits and Systems, vol. 2, pp. 529-531, (1998).
Gower, John, Optical Communications Systems, 2nd edition, Prentice Hall, 1993, pp. 40-46.
From Chinese Office Action dated Dec. 2, 2014 from Chinese Patent Application No. 201280021746 with English summary.
Gregoire, et al., "A Coaxial TEM cell for Direct Measurement of UHF Artificial Magnetic Conductors", IEEE Antenna and Propagation Magazine, vol. 54, pp. 251-259, 2012.
Slideshow for "Matching Network Design Using Non-Foster Impedances" by Stephen E. Sussman-Fort, Ph.D. of EDO Corporation (printed from the Internet on Jun. 30, 2011) (pp. 1-43).
Cyril Svetoslavov Mechkov, "A heuristic approach to teaching negative resistance phenomenon," Third International Conference-Computer Science '06, Istanbul, Turkey, Oct. 12-15, 2006 (pp. 1-6).
White Paper by the Virginia Tech Antenna Group of Wireless @ Virgina Tech, "Non-Foster Reactance Matching for Antennas," pp. 1-5, http://wireless.vt.edu/research/Antennas_Propagation/Whitepapers/Whitepaper-Non-Foster_Reactance_Matching_for_Antennas.pdf, published at least before Apr. 27, 2010.
Sussman-Fort, S., "Gyrator-Based Biquad Filters and Negative Impedance Converters for Microwaves," International Journal of RF and Microwave Computer-Aided Engineering, vol. 8, No. 2, pp. 86-101, (1998).
Sussman-Fort, S. E., "Matching Network Design Using Non-Foster Impedances,"International Journal of RF and Microwave Computer-Aided Engineering, vol. 16, Issue 2, pp. 1-8, (Mar. 2006).
S.E. Sussman and R.M. Rudish, "Non-Foster Impedance matching for transmit applications," IEEE Xplore, EDO Corporation and Dept. of Electrical and Computer Engineering. pp. 53-56, Mar. 2006.
Sussman-Fort, S. E. And Rudish, R. M., "Increasing Efficiency or Bandwidth of Electrically Small Transmit Antennas by Impedance Matching With Non-Foster Circuits," Progress in Electromagnetics Research Symposium 2006, pp. 137 and pp. 1-22, (Mar. 2006).
Bezooijen et al. "RF-MEMS Based Adaptive Antenna Matching Module," IEEE Radio Frequency Integrated Circuits Symposium, pp. 573-576, (2007).
J.G. Linvill, "Transistor negative-impedance converters", Proceedings of the IRE, vol. 41, pp. 725-729, Jun. 1953.
Brennan et al., "The CMOS Negative Impedance Converter," IEEE Journal of Solid-State Circuits, vol. 23, No. 5, pp. 1272-1275, (Oct. 1988).
Fong et al., "Scalar and Tensor Holographic Artificial Impedance Surfaces," IEEE Transactions on Antennas and Propagation, vol. 58, No. 10, pp. 3212-3221, (Oct. 2010).
Colburn et al., "Adaptive Artificial Impedance Surface Conformal Antennas," Proceedings IEEE Antennas and Propagation Society International Symposium, pp. 1-4, (2009).
K. Song and R.G. Rojas, "Non-foster impedance matching of electrically small antennas, "Proc. IEEE Ant. Prop. Int. Symp., pp. 1-4, Jul. 2010.
D.J. Gregoire, et al.,"Non-foster metamaterials", Antenna Applications Symposium 2011, pp. 1-15, Sep. 2011.
EPO Supplementary European Search Report with European Search Opinion dated Oct. 8, 2014 from European Patent Application No. 12768357.1.
Chen, Y., "Wideband Varactorless LC VCO Using a Tunable Negative-Inductance Cell," IEEE Transactions on Circuits and Systems, I: Regular Papers, vol. 57, No. 10, pp. 2609-2617, (Oct. 2010).
Ramirez-Angulo, J. And Holmes, M., "Simple Technique Using Local CMFB to Enhance Slew Rate and Bandwidth of One-Stage CMOS op-amps," Electronics Letters, vol., 38, No. 23, pp. 1409-1411, (Nov. 2002).
From Chinese Patent Application No. 2012800334482 Chinese Office Action dated Oct. 27, 2014 with English translation.
Staple et al., "The End of Spectrum Scarcity," published by IEEE Spectrum, pp. 1-5, (Mar. 2004).
EPO Supplementary European Search Report with European Search Opinion dated Jul. 29, 2014 from European Patent Application No. 12767559.3.
Hrabar et al., "Towards Active Dispersionless ENZ Metamaterial for Cloaking Applications," Metamaterials, vol. 4, No. 2-3, pp. 89-97, (Jul. 2010).
Kern D. J., et al., "Design of Reconfigurable Electromagnetic Bandgap Surfaces as Artificial Magnetic Conducting Ground Planes and Absorbers", Antennas and Propagation Society International Symposium 2006, IEEE Albuquerque, NM, USA Jul. 9-14, 2006, Piscataway, NJ, USA, IEEE, Piscataway, NJ, USA, Jul. 9, 2006, pp. 197-200.
From U.S. Appl. No. 12/768,563 (now U.S. Pat. No. 8,374,561), Application and Office Actions including but not limited to the Office Actions dated Jun. 13, 2012; Oct. 9, 2012; and Oct. 23, 2012, pp. 1-19.
From U.S. Appl. No. 13/441,730, Notice of Allowance dated Nov. 10, 2014.
From U.S. Appl. No. 13/441,730, Notice of Allowance dated Jul. 28, 2014.
From U.S. Appl. No. 13/441,730, Office Action dated Mar. 13, 2014.
From U.S. Appl. No. 13/177,479, Non-Final Rejection dated Dec. 2, 2014.
From U.S. Appl. No. 13/177,479, Office Action dated Jun. 4, 2014.
From U.S. Appl. No. 13/472,396, Office Action dated Dec. 2, 2014.
From U.S. Appl. No. 13/472,396, Office Action dated Jul. 30, 2014.
From Chinese Patent Application No. 201280021449.5, PRC First Office Action dated Sep. 29, 2015 with machine translation.
From PCT Application No. PCT/US2012/032638, Chapter II, International Preliminary Report on Patentability (IPRP) dated Jun. 27, 2013.
From PCT Application No. PCT/US2012/032638, International Search Report and Written Opinion (ISR & WO) dated Oct. 29, 2012.
From PCT Application No. PCT/US2012/032648, Chapter I, International Preliminary Report on Patentability (IPRP) dated Oct. 8, 2013.

(56) References Cited

OTHER PUBLICATIONS

From PCT Application No. PCT/US2012/032648, International Search Report and Written Opinion (ISR & WO) dated Dec. 14, 2012.
From PCT Application No. PCT/US2012/045632, Chapter II, International Preliminary Report on Patentability (IPRP) dated Jul. 10, 2013.
From PCT Application No. PCT/US2012/045632, International Search Report and Written Opinion (ISR & WO) dated Jan. 10, 2013.
From PCT Application No. PCT/US2014/072233, International Search Report and Written Opinion (ISR & WO) dated Mar. 16, 2015.
International Preliminary Report on Patentability for PCT/US2014/072233 dated Aug. 30, 2016.
From U.S. Appl. No. 13/441,659 (Now U.S. Pat. No. 8,976,077), Non-Final Rejection dated Feb. 24, 2014.
From U.S. Appl. No. 13/441,659 (Now U.S. Pat. No. 8,976,077), Final Office Action dated Jul. 1, 2014.
From U.S. Appl. No. 13/441,659 (Now U.S. Pat. No. 8,976,077), Notice of Allowance dated Oct. 30, 2014.
From U.S. Appl. No. 13/910,039 (now U.S. Pat. No. 10,103,445 ), Office Action dated Jun. 15, 2015.
From U.S. Appl. No. 13/910,039 (now U.S. Pat. No. 10,103,445 ), Office Action dated Nov. 25, 2015.
From U.S. Appl. No. 13/910,039 (now U.S. Pat. No. 10,103,445 ), Office Action dated Jun. 29, 2016.
From U.S. Appl. No. 13/910,039 (now U.S. Pat. No. 10,103,445 ), Office Action dated Jan. 10, 2017.
From U.S. Appl. No. 13/910,039 (now U.S. Pat. No. 10,103,445 ), Office Action dated Sep. 12, 2017.
From U.S. Appl. No. 13/910,039 (now U.S. Pat. No. 10,103,445 ), Office Action dated Dec. 15, 2017.
From U.S. Appl. No. 13/910,039 (now U.S. Pat. No. 10,103,445 ), Notice of Allowance dated Jun. 14, 2018.
Satellite Communication Payload and System by Teresa M. Braum, Wiley-IEEE Press, Sep. 2012, entire document.
From U.S. Appl. No. 14/628,076 Office Action dated Apr. 20, 2016.
From U.S. Appl. No. 14/628,076 Office Action dated Aug. 22, 2016.
From U.S. Appl. No. 14/628,076 Notice of Allowance dated Dec. 14, 2016.
From U.S. Appl. No. 14/628,076 Notice of Allowance dated Mar. 14, 2017.
He, et al., 3D broadband isotropic NRI metamaterial based on metallic cross-pairs, Jouranl of Magnetism and Magnetic Materials, Mar. 2011, entire document.
From U.S. Appl. No. 14/188,264 Office Action dated Mar. 2, 2016.
From U.S. Appl. No. 14/188,225 Office Action dated Nov. 3, 2015.
From U.S. Appl. No. 14/188,225 Notice of Allowance dated Mar. 11, 2016.
From U.S. Appl. No. 14/335,737 Office Action dated Dec. 30, 2015.
From U.S. Appl. No. 14/335,737, Notice of Allowance dated Apr. 28, 2016.
EPO Office Action dated Nov. 5, 2018 from European Patent Application No. 12806913.5.
EPO Office Action dated May 16, 2019 from European Patent Application No. 12768357.1.
EPO Office Action dated May 31, 2018 from European Patent Application No. 12767559.3.
EPO Office Action dated Jun. 19, 2019 from European Patent Application No. 12767559.3.

* cited by examiner 303
301
304

304
305
301
302

303
302
301
304
305

BROADBAND DUAL POLARIZATION ACTIVE ARTIFICIAL MAGNETIC CONDUCTOR

STATEMENT REGARDING FEDERALLY SPONSORED RESEARCH OR DEVELOPMENT

The invention was made with Government support and that the Government has certain rights in the invention.

CROSS REFERENCE TO RELATED APPLICATIONS

This application is related to U.S. patent application Ser. No. 14/188,225 filed on Feb. 24, 2014 (now U.S. Pat. No. 9,379,448), U.S. patent application Ser. No. 14/856,541 filed on Sep. 16, 2015 which claims the benefit of U.S. Provisional Patent Application Ser. No. 62/051,778 filed on Sep. 17, 2014, U.S. patent application Ser. No. 13/441,659 filed on Apr. 6, 2012 (now U.S. Pat. No. 8,976,077) which claims the benefit of U.S. Provisional Patent Application Ser. Nos. 61/537,488 and 61/473,076 filed on Sep. 21, 2011 and Apr. 7, 2011, respectively, U.S. patent application Ser. No. 14/188,264 filed on Feb. 24, 2014, U.S. patent application Ser. No. 14/628,076 filed on Feb. 20, 2015 (now U.S. Pat. No. 9,705,201), International Application No. PCT/US14/72233 filed on Dec. 23, 2014, International Application No. PCT/US12/32638 filed on Apr. 6, 2012, and International Application No. PCT/US12/32648 filed on Apr. 6, 2012, which are incorporated herein by reference.

REFERENCE TO NON-PATENT LITERATURE

The following references are incorporated by reference as though set forth in full.

[1] Gregoire, D.; White, C.; Colburn, J., "Wideband Artificial Magnetic Conductors Loaded with Non-Foster Negative Inductors," Antennas and Wireless Propagation Letters, IEEE, Vol. 10, 1586-1589, 2011.

[2] D. Sievenpiper, L. Zhang, R. Broas, N. Alexopolous, and E. Yablonovitch, "High-impedance Electromagnetic Surfaces with a Forbidden Frequency Band," IEEE Transactions on Microwave Theory and Techniques, Vol. 47, No. 11, pp. 2059-2074, November 1999.

[3] F. Costa, S. Genovesi, and A. Monorchio, "On the Bandwidth of High-Impedance Frequency Selective Surfaces", IEEE Antennas and Wireless Propagation Letters, Vol. 8, pp. 1341-1344, 2009.

[4] D. J. Kern, D. H. Werner and M. H. Wilhelm, "Active Negative Impedance Loaded EBG Structures for the Realization of Ultra-Wideband Artificial Magnetic Conductors," Proc. IEEE Ant. Prop. Int. Symp., Vol. 2, 2003, pp. 427-430.

[5] White, C. R.; May, J. W.; Colburn, J. S., "A Variable Negative-Inductance Integrated Circuit at UHF Frequencies," IEEE Microwave and Wireless Components Letters, Vol. 21, No. 1, 35-37, 2012.

[6] O. Luukkonen et al, "Simple and Accurate Analytical Model of Planar Grids and High-Impedance Surfaces", IEEE Transactions on Antennas Propagation, Vol. 56, No. 6, pp 1624-1632, 2008.

[7] R. M. Foster., "A Reactance Theorem", Bell Systems Technical Journal, Vol. 3, pp. 259-267, 1924.

[8] Gregoire, D. J.; Colburn, J. S.; White, C. R., "A Coaxial TEM Cell for Direct Measurement of UHF Artificial Magnetic Conductors", IEEE Antennas and Propagation Magazine, Vol. 54, No. 2, pp. 251-250, 2012.

[9] S. Stearns, "Non-Foster Circuits and Stability Theory," Proc. IEEE Ant. Prop. Int. Symp., 2011, pp. 1942-1945.

[10] S. E. Sussman-Fort and R. M. Rudish, "Non-Foster Impedance Matching of Electrically-Small Antennas," IEEE Transactions on Antennas and Propagation, Vol. 57, No. 8, pp 2230-2241, August 2009.

[11] C. R. White and G. M. Rebeiz, "A Shallow Varactor-Tuned Cavity-Backed Slot Antenna with a 1.9:1 Tuning Range," IEEE Transactions on Antennas and Propagation, Vol. 58, No. 3, pp 633-639, 2010.

TECHNICAL FIELD

The present disclosure is directed in general to the field of artificial magnetic conductors (AMCs) and frequency-selective surfaces (FSSs). In particular, this invention is directed to the area of Active Artificial Magnetic Conductors (AAMCs).

BACKGROUND OF THE DISCLOSURE

While naturally occurring conductors reflect electromagnetic waves out of phase, AMCs are metamaterial structures that reflect incident electromagnetic waves in phase. These metamaterial structures are particularly useful as replacements for metallic surfaces in applications where antennas have to be placed near and/or parallel to metallic surfaces. AMCs typically comprise homogenous unit cells having dimensions that are less than a half wavelength of a desired transmitted radiation and achieve their properties by resonance.

AMC surfaces are generally designed to have an allotted set of frequencies over which electromagnetic surface waves and currents can propagate; hence, AMCs are often referred to as "frequency-selective surfaces". These materials can be incorporated as antenna ground planes, small flat signal processing filters, or filters as part of waveguide structures. AMC surfaces can effectively attenuate undesirable surface wave propagation and produce improved radiation patterns. This is because the AMC can suppress surface wave propagation within a prescribed range of forbidden frequencies.

In general, an AMC surface can have a very high surface impedance within a specific frequency range, wherein the tangential magnetic field strength can be small compared to the strength of the electric field along the surface. A typical passive AMC comprises patches disposed over a ground plane, with conductive vias coupling the patches to the radio frequency (RF) ground. Passive AMCs are isotropic and can operate for any incident wave polarization.

AMC surfaces can have narrow bandwidths of operation. Attempts to increase AMC bandwidths have resulted in unstable circuits with unwanted oscillations or conditionally stable circuits with certain limitations. As an example, integrating negative inductors or non-Foster circuits (NFCs) into a passive AMC can result in instability in the E-plane of the AMC. This instability can however be reduced by, for example, changing the configuration of the couplings between conductive patches in an AMC and adjusting the impedance of the NFCs that couple the conductive patches of the AMC.

AMC technology is applicable to a number of antenna applications including 1) increasing antennae bandwidths, 2) reducing finite ground plane edge effects for antennas mounted on structures to improve the radiation patterns of the antennas, 3) reducing couplings between closely spaced ($<1\lambda$) antenna elements on certain structures to mitigate co-site interference, 4) enabling the radiation of energy polarized parallel to and directed along structural metal surfaces, and 5) increasing the bandwidth and efficiency of cavity-backed slot antennas while reducing cavity size. The AMC technology disclosed herein can be particularly applicable for frequencies less than 1 GHz, where the thickness of the traditional AMC becomes prohibitive for most practical applications.

SUMMARY OF THE INVENTION

One embodiment described in this disclosure comprises an AAMC comprising a rectangular array or lattice of unit cells, each unit cell comprising a NFC having a negative inductance and/or negative capacitance and coupled in a crossover configuration that can restrain or suppress the two-dimensional quadrupole mode of the AAMC.

The AAMC can operate independently of wave polarization; thus it can be referred to as a dual-polarization AAMC or a dual-pol AAMC. The AAMC can comprise a square array of patches or plates shunted to ground or a ground plane by conductive vias (also known as mushroom unit cells). NFCs can couple adjacent metal plates in a crossover configuration. This crossover configuration can restrain or suppress the quadrupole mode of the AAMC, reducing instability therein.

The AAMC can comprise: a plurality of impedance elements arranged in rows and columns on a dielectric substrate, with a distance or gap positioned between adjacent impedance elements, and one or more circuits coupling neighboring impedance elements in a crossover configuration. The circuits can be NFCs comprising negative inductors and/or negative capacitors. The negative inductors and negative capacitors of the NFCs can be coupled in parallel between neighboring impedance elements. The impedance elements can comprise conductive patches or metallic regions on a layer of a dielectric substrate of the AAMC.

The AAMC can comprise an array of impedance elements arranged along a surface; a plurality of NFCs coupling said impedance elements to each other so as to form a first network of impedance elements and NFCs and a second network of impedance elements and NFCs, wherein the first and second networks of impedance elements and NFCs are distinct, interleaved networks of impedance elements and NFCs.

An embodiment of the proposed system comprises a periodic array of unit cells that reflects electromagnetic waves polarized parallel to a surface with a zero-degree phase shift. The system comprises an array of unit cells having impedance elements connected to neighboring impedance elements with NFCs in a crossover configuration, each impedance element being coupled to a ground plane with a conductive via. The system provides operational stability to the AAMC in addition to supporting a broadband operation.

A method of fabricating an artificial magnetic conductor can comprise: forming a substrate on a grounded conductive layer, arranging an array of impedance elements on the substrate with a distance or gap between the regions, coupling the impedance elements with NFCs having negative inductance and/or negative capacitance in a crossover configuration, forming a first network of impedance elements and NFCs and a second network of impedance elements and NFCs, and constructing low impedance or conductive vias coupling the impedance elements to the ground plane, thereby coupling the first network of impedance elements and NFCs to the second network of impedance elements and NFCs.

Certain embodiments can provide various technical features depending on the implementation thereof. For example, a technical feature of some embodiments can include the capability to provide a large bandwidth of operation while suppressing or restraining unstable modes of the AAMC. Other embodiments can focus on tuning the bandwidth of operation while maintaining a stable AAMC design.

Although specific features have been enumerated above, various embodiments can include some, none, or all of the enumerated features. Additionally, other technical features will become readily apparent to one of ordinary skill in the art after review of the following figures and description.

BRIEF DESCRIPTION OF THE DRAWINGS

For a more complete understanding of the present disclosure and its features, reference is now made to the following description taken in conjunction with the accompanying drawings, in which like reference numerals represent like parts.

DETAILED DESCRIPTION

Although example embodiments are illustrated below, the present technology can be implemented using any number of techniques, whether currently known or not. The present technology should in no way be limited to the example implementations, drawings, and techniques illustrated herein. The drawings are not necessarily drawn to scale.

An AMC is a type of metamaterial that emulates a magnetic conductor over a limited bandwidth. AMC ground planes enable conformal antennas to have currents flowing parallel to their surfaces because the image currents in the AMC ground planes are in phase with their current sources. AMCs can comprise laminated structures composed of periodic grids of metallic patches distributed on grounded dielectric layers. AMCs have limited bandwidth, which is proportional to the AMC's substrate thickness and permeability. At VHF-UHF, the substrate thickness necessary for a reasonable AMC bandwidth is excessively large for antenna, ground-plane applications. Highly permeable materials are undesirable at these frequencies because they are generally expensive, heavy, and present high-loss with respect to antenna efficiency.

The bandwidth limitation of an AMC can be overcome by using an AAMC. The AAMC can be loaded with NFCs having negative inductances that couple the neighboring impedance elements, which can increase the AMC bandwidth by 10 times or more. The NFC's negative inductance is loaded in parallel with the substrate inductance resulting in a much larger net inductance and hence, a much larger AMC bandwidth.

Figure 1B:
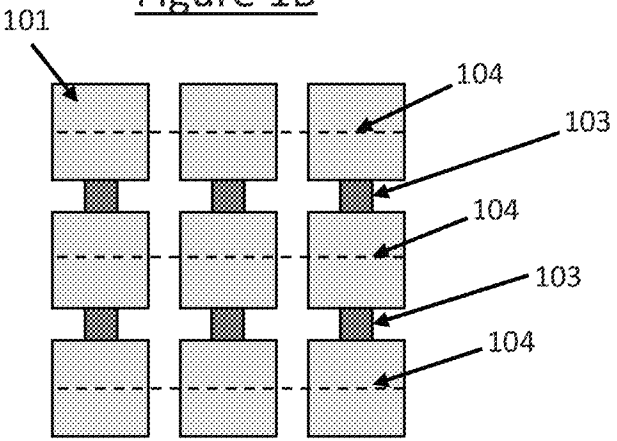
FIG. 1B illustrates an arrangement of the unit cell architecture shown in FIG. 1A.
Figure 1A:
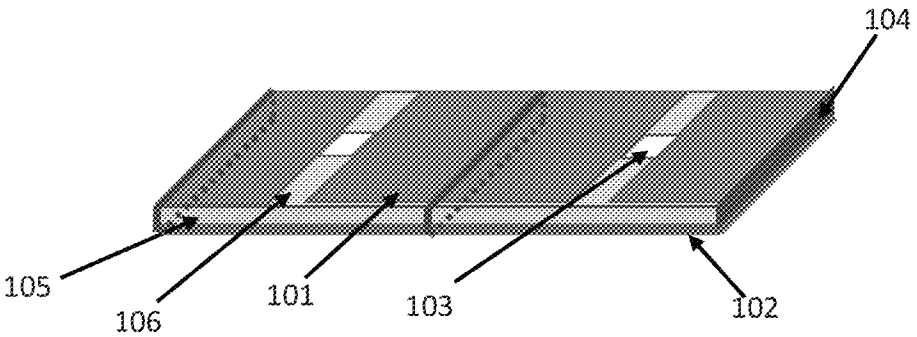
FIG. 1A illustrates a single polarization AAMC unit cell architecture.

FIG. 1A illustrates the unit cells of a single polarization AAMC. FIG. 1B illustrates an arrangement of the AAMC unit cells architecture of FIG. 1A. In FIG. 1A, regions 101 represent patches, which can be conductive surfaces or regions on a substrate 105. Substrate 105 can comprise any dielectric material such as, for example, foam or air. Layer 102 represents the ground plane. Radio Frequency (RF) isolation plates 104 connect the patches 101 to the ground plane 102. Circuits or NFCs are represented by elements 103 and are positioned within gap channels 106. For single polarization surfaces, RF isolation plates 104, as shown in FIG. 1B, restrict oscillations to desired operating conditions.

An E-plane of a single-polarization antenna can be defined as a plane containing the electric field vector and the direction of maximum radiation. For the AAMC of FIGS. 1A and 1B, the E-plane is the plane containing the array of patches 101. An H-plane of a single-polarization antenna can be defined as a plane containing the magnetic field vector and the direction of maximum radiation. For the AAMC of FIGS. 1A and 1B, the H-plane is the plane perpendicular to the E-plane and can be defined as the plane containing a row of isolation plates 104.

Couplings between neighboring NFCs 103 in the E-plane of the AAMC (i.e. between NFCs 103 in neighboring rows in FIG. 1B) cause the single-polarization AAMC to be unstable for broadband NFC loadings. In order to stabilize the AAMC at an increased bandwidth, RF isolation plates 104 are installed between rows of elements in the H-plane of the AAMC. The RF isolation plates 104 span through the substrate 105, from the ground plane 102 to the conductive patches 101. The AAMC operates for RF incident waves polarized perpendicular to the RF isolation plates 104. Incident waves polarized along other axes will be partially or fully reflected as they would from a metal conductor because of the waves' interactions with the RF isolation plates 104. NFCs 103 between neighboring rows in the E-plane of the AAMC are not coupled in an unstable manner because of the presence of RF isolation plates 104.

The AAMC of FIGS. 1A and 1B is loaded with circuits 103, which can include NFCs having negative inductors/inductance. The NFCs 103 enable the AAMC to have a high bandwidth. NFCs are so named because they circumvent Foster's reactance theorem with an active circuit. Details of a NFC circuit design and fabrication are known to those skilled in the art. Foster's reactance theorem states that all lossless, passive two-terminal devices have a reactance that has a positive frequency derivative. A circuit that has a reactance, wherein a frequency derivative of the reactance is negative, is a non-Foster circuit (NFC). Here, the word "reactance" means the imaginary part of the complex electrical impedance. A negative inductor having a reactance of $-j\omega L$, where j is an imaginary number, w is angular frequency, and L is inductance, is one example of a NFC. A negative capacitor having a reactance of $j/(\omega C)$, where C is capacitance, is another example of a NFC.

Figure 4:
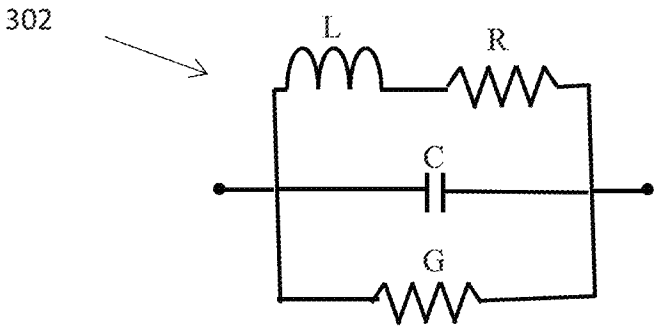
FIG. 4 depicts a circuit equivalent to a NFC.

Each NFC can be represented by the equivalent circuit model shown in FIG. 4. In this equivalent circuit model, $L_{NFC}$ (denoted as L in FIG. 4) is the desired negative inductance and $R_{NFC}$ (denoted as R in FIG. 4) is negative resistance. $C_{NFC}$ and $G_{NFC}$ (denoted as C and G in the FIG. 4) are positive capacitance and conductance, respectively. In an ideal NFC, $R_{NFC}$, $C_{NFC}$ and $G_{NFC}$ are all equal to zero. The equivalent circuit parameters vary according to the bias voltage applied to the NFC.

An AMC can be characterized by: 1) its resonant frequency, $\omega_0$, which is the frequency at which an incident wave is reflected with a 0° phase shift; and by 2) its ±90° bandwidth, which is defined as the incident wave frequency range wherein the reflected wave phase is within the range $|\varphi_r|<90$. An AMC response can be accurately modeled over a limited frequency range using an equivalent parallel LRC circuit with $L_{AMC}$, $C_{AMC}$, and $R_{AMC}$ as the circuit's inductance, capacitance, and resistance, respectively. The circuit impedance is $$Z_{AMC} = \frac{j\omega L_{AMC}}{1 - \omega^2 L_{AMC} C_{AMC} + j\omega L_{AMC} / R_{AMC}}. \tag{1}$$

The resonant frequency t and approximate fractional bandwidth (BW) in the limit $\omega L_{AMC}<Z_0$ are $$\omega_0 = \sqrt{\frac{1}{L_{AMC} C_{AMC}}},\ BW = \omega_0 L_{AMC} / Z_0,\ BW = \frac{1}{Z_0}\sqrt{\frac{L_{AMC}}{C_{AMC}}}, \tag{2}$$

where $Z_0$ is the incident wave impedance. The AMC shown in FIG. 1A can be modeled using a simple transmission line model which expresses the AMC admittance as the sum of the grid admittance $Y_g$, the load admittance $Y_{load}$, and the substrate admittance $Y_{sub}$:

$$Y_{AMC}=Y_g+Y_{load}+Y_{sub}. \tag{3}$$

$$Y_{sub}=-j\cot(\sqrt{\varepsilon\mu}\omega d)\sqrt{\varepsilon/\mu}, \tag{4}$$

where d is the dielectric thickness, and ε and μ are the substrate's permittivity and permeability respectively. $Y_{sub}$ is expressed in terms of a frequency dependent inductance, $L_{sub}=-j/(\omega Y_{sub})$ which is approximately a constant $L_{sub}\cong\mu d$ for thin substrates with $\sqrt{\varepsilon\mu}\omega d<<1$. The grid impedance of the metallic squares is capacitive, $Y_g=j\omega C_g$, and can be accurately estimated analytically.

The loaded AMC reflection properties can be estimated by equating the LRC circuit parameters of equation (1) to quantities in the transmission line model in equations (3) and (4). If the load is capacitive, then the equivalent LRC circuit parameters are $$L_{AMC}=L_{sub},\ C_{AMC}=C_g+C_{load} \text{ and } R_{AMC}=R_{load}. \tag{5}$$

If the load is inductive as it is in the AAMC, then they are $$L_{AMC} = \frac{L_{Load} L_{sub}}{L_{Load} + L_{sub}},\ C_{AMC} = C_g \text{ and } R_{AMC} = R_{load}. \tag{6}$$

An active AMC is created when the load inductance is negative, and $L_{AMC}$ increases according to (6). When $L_{load}<0$ and $|L_{load}|>L_{sub}>0$, then $L_{AMC}>L_{sub}$, resulting in an increase in the AMC bandwidth, and a decrease in the resonant frequency according to (2). As $L_{load}$ approaches $-L_{sub}$, $L_{AMC}$ increases towards a maximum, the resonant frequency $\omega_0$ decreases towards a minimum, and the bandwidth increases towards a maximum. Due to instability, the AMC will have a finite maximum $L_{AMC}$ and a finite minimum $\omega_0$ as $L_{load}$ approaches $-L_{sub}$. The bandwidth and resonant frequency are prevented from going to infinity and zero respectively by the loss and capacitance of the NFC and the AMC structure.

NFCs become unstable when their applied bias voltage is too high, when they are subjected to excessive RF power, and/or when they are detrimentally coupled to neighboring NFCs. Their instability is manifested by circuit oscillation and emissions of radiation from the NFC circuit. When the NFCs in an AAMC become unstable, the AAMC can no longer operate as an AMC and can become useless. One consequence of this is that previously, it has not been possible to create a broadband dual-polarization AAMC because of the instability caused by the couplings between neighboring NFCs.

The stability of finite AAMCs can be approximated using eigenanalysis. For this, it is helpful to introduce the concept of a port. A port can be defined by a pair of terminals within an electrical network such as an AAMC or AMC. Generally, the current flowing into one terminal of the port equals the current flowing out of the other terminal. If the AAMC is loaded with NFCs, each port of the AAMC can be defined by a pair of terminals wherein the terminals are located at the edges of neighboring impedance elements where a single NFC is connected. A single NFC is connected across the terminals of each port. If the NFCs of the AAMC are removed, resulting in an AMC, the locations of the ports of the AMC would be unchanged to simplify the analysis of the AAMC and to ensure that the following condition holds: $Y_{AAMC}=Y_{AMC}+Y_{NFC}$, where $Y_{AAMC}$ is the admittance of the AAMC, $Y_{AMC}$ is the admittance of the AMC (which is equivalent to the AAMC with the NFCs removed), and $Y_{NFC}$ is a scalar admittance matrix introduced by the NFCs. At frequencies below the resonance frequency, the admittance matrix of the AAMC can be approximated by self and mutual inductances of the ports of the AAMC:

$$Y \approx \frac{1}{s}\begin{pmatrix} \frac{1}{L_{11}} & \cdots & \frac{1}{L_{1N}} \\ \vdots & \ddots & \vdots \\ \frac{1}{L_{N1}} & \cdots & \frac{1}{L_{NN}} \end{pmatrix} \tag{7}$$

where N is the number of ports in the AAMC, $L_{ii}$ for i=1 to N is the self inductance of the ith port, $L_{ij}$ for i=1 to N, j=1 to N, and $i \neq j$ is the mutual inductance between the ith and jth ports, and $s=j2\pi f$ is the complex radian frequency of the Laplace transform. Thus the admittance matrix can be simplified to 1/s times an inductance matrix where the eigenvalues of the inductance matrix quantify an equivalent inverse inductance $1/L_{eq}$ for a given eigenmode of the AAMC. Assuming all NFCs are identical with inductance $L_{NFC}<0$ (L in FIG. 4), the total inductance of the AAMC is the parallel combination of the eigenvalue $L_{eq}$ and $L_{NFC}$; the network is stable if $L_{NFC}<-L_{eq}$ for all eigenvalues.

Figure 2B:
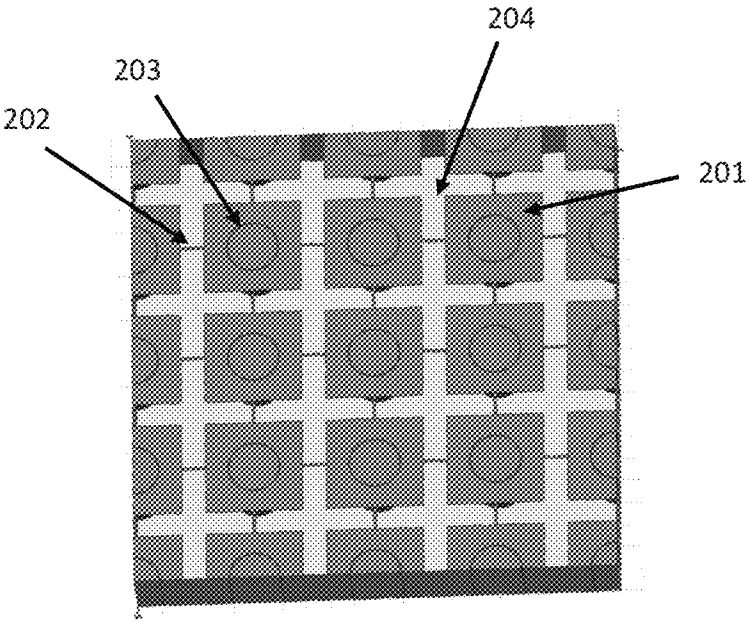
FIGS. 2A and 2B illustrate a top view of a dual polarization AAMC.
Figure 2A:
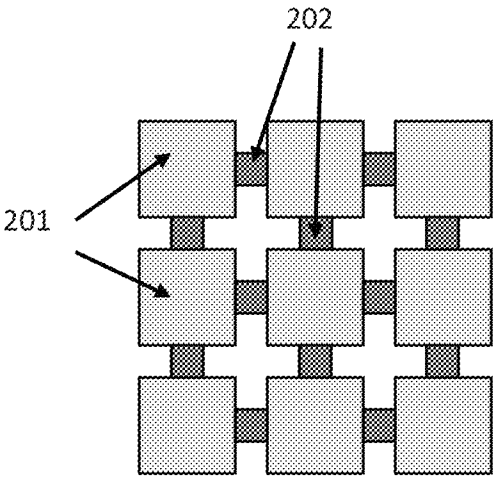

Turning to FIGS. 2A and 2B and in an implementation of a dual-polarization AAMC, the AAMC incorporates a low inductance shunt 203 to suppress coupling between the NFCs and impedance elements. This allows a more stable operation of the AAMC but the structure can have a reduced bandwidth due to an easily accessible quadrupole mode. In another embodiment a cavity backed AAMC is used, where the cavity suppresses both E-plane and H-plane couplings between the NFCs and the impedance elements. This allows a dual-polarization operation of the AAMC but the AAMC can still have an easily accessible quadrupole mode and a reduced bandwidth due to its lower inductance.

While FIGS. 2A and 2B illustrate an implementation of a dual polarization AAMC, this embodiment has stability issues. In FIG. 2A, conductive patches 201 are arranged in rows and columns and circuits 202 couple nearest neighboring patches 201 between adjacent columns and rows. Circuits 202 can comprise NFCs and/or negative inductors and can couple neighboring patches 201. Removing the RF isolation plates 104 (as seen in FIGS. 1A and 1B) and adding circuits 202 in two different directions allows a dual-polarization operation of the AAMC, but the AAMC can still have stability issues which can be quantified in terms of its bandwidth. The AAMC of FIGS. 2A and 2B is less stable and operates at a reduced bandwidth as a dual-polarization AAMC due to the absence of the isolation plates.

Figure 3:
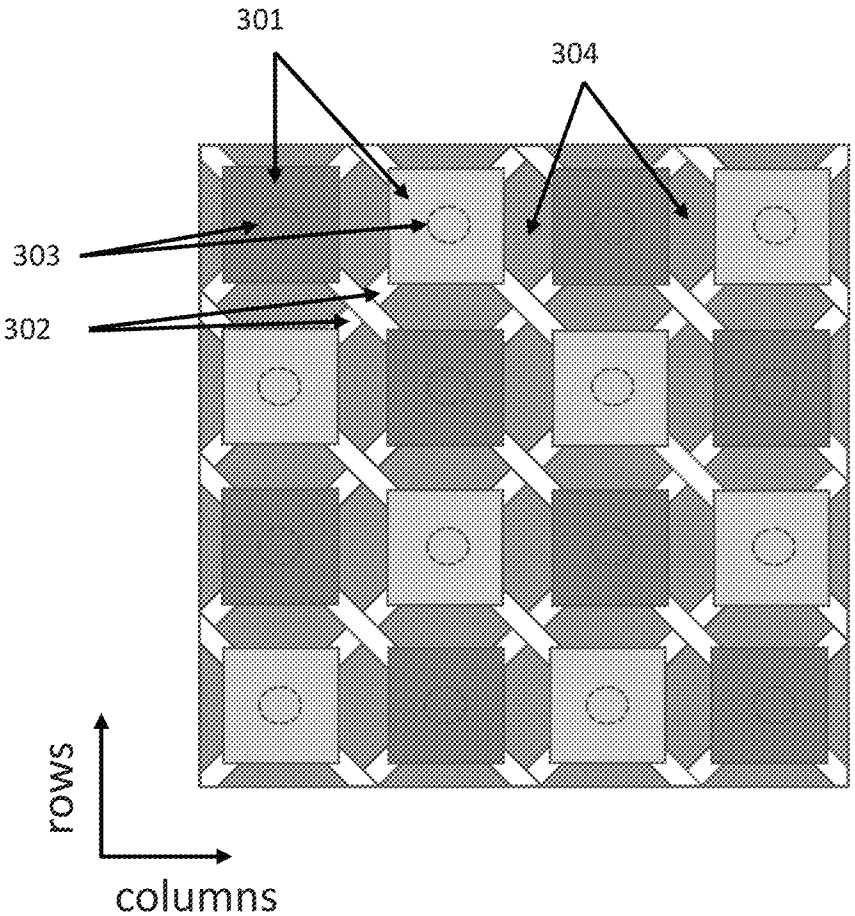
FIG. 3 illustrates a dual polarization AAMC wherein NFCs couple neighboring impedance elements in a crossover configuration.

An embodiment according to the principles of this invention is shown in FIG. 3. FIG. 3 illustrates a dual polarization AAMC wherein NFCs diagonally couple neighboring impedance elements in a crossover configuration. The AAMC depicted in FIG. 3 comprises an array of impedance elements 301 disposed above a surface comprising a dielectric substrate 304. The impedance elements 301 are connected to a ground plane (not shown) by vias/shunts 303 which will be discussed in more detail hereafter. NFCs 302 form a crossed configuration and couple impedance elements 301 diagonally in the array of rows and columns, as shown in FIG. 3. NFCs 302 couple neighboring impedance elements 301 to each other to form first and second networks of interconnected impedance elements (depicted with darker and lighter gray scale elements, respectively in FIG. 3). The first and second networks can comprise first and second networks of interconnected impedance elements 301 and NFCs 302, wherein NFCs 302 of the first network couple diagonally adjacent or neighboring impedance elements 301 of the first network, and NFCs 302 of the second network couple diagonally adjacent or neighboring impedance elements 301 of the second network. Further, in at least one embodiment, the NFCs 302 of the first network do not couple impedance elements 301 of the second network, and NFCs 302 of the second network do not couple impedance elements 301 of the first network. The interconnected impedance elements 301 of the first and second networks are interleaved along the surface of the dielectric substrate. In this writing, the term "interleaved" means "arranged in or as if in alternate or generally alternate layers, objects, or elements", as can be observed in FIG. 3.

The shape of impedance elements 301 is not limited to the square shape shown and can be triangular, rectangular, elliptical, circular, octagonal, diamond, polygonal, etc. In addition, the shape of patch 301 can be x-like and/or non-uniform, wherein each patch 301 has a unique or non-unique, irregular shape.

The AAMC of FIG. 3 illustrates a broadband active artificial magnetic conductor that can operate independently of incident wave polarization; thus it can be referred to as a dual-polarization AAMC or a dual-pol AAMC. In FIGS. 2A and 2B, the NFCs 202 are coupled between adjacent, nearest neighboring patches 201 and are coupled at the centers of the sides thereof in both horizontal and vertical directions. In the crossover configuration of FIG. 3 the NFCs 302 are coupled diagonally between impedance elements 301. The NFCs 302 of FIG. 3 can be coupled at the corners or at the sides or edges of the impedance elements 301.

The AAMC of the present disclosure should not be limited to the crossover configuration shown in FIG. 3. It will be readily apparent to one skilled in the art that NFCs 302 can cross over (or under) impedance elements 301. NFCs 302 can cross over (or under) each other, and/or they can cross over (or under) neighboring impedance elements 301, defining a crossover configuration according to the principles of the present disclosure.

The NFCs 302 can be any circuit having the aforementioned negative inductance and/or inductors. NFCs 302 can comprise combinations of negative inductance elements and/or inductors in parallel with negative capacitance elements and/or capacitors.

Figures 5A, 5B, 5C:
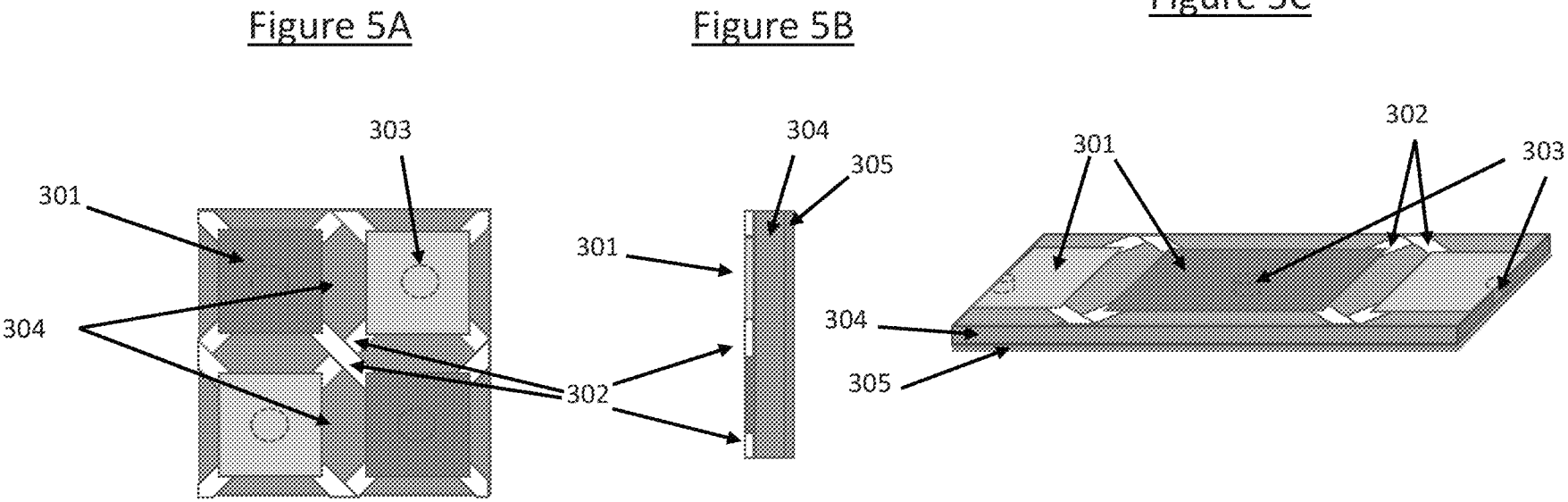
FIG. 5A illustrates a top view of four adjacent unit cells of a dual polarization AAMC.
FIG. 5B illustrates a side view of the four adjacent unit cells of FIG. 5A.
FIG. 5C illustrates a cross-sectional view of three adjacent unit cells of a dual polarization AAMC.

FIG. 5A illustrates a unit cell arrangement with impedance elements 301 that are diagonally coupled in a crossover configuration. FIG. 5A depicts a top view of the arrangement and FIG. 5B represents a side view of the arrangement. FIG. 5C depicts a cross-section view of the arrangement. The impedance elements 301 can be conductive patches that comprise conductive material, such as conductive metal plates or metal deposits, and highly doped materials such as silicon. FIG. 5C depicts the via 303 coupling a patch 301 to the ground plane 305. Vias 303 are act as shunts that couple impedance elements 301 to the ground plane 305. Vias/shunts 303 can have a low impedance and/or low inductance such that the mutual coupling between impedance elements and/or the NFCs is minimized and/or reduced thereby making the AAMC stable or more stable. Decreasing the impedance of the shunts 303 can comprise increasing a cross-sectional area of the shunts 303. The shunts 303 can be made of metal, alloys, and/or electrically conductive material.

The AAMC of FIGS. 5A, 5B, and 5C does not comprise the isolation plates 104 depicted in FIGS. 1A and 1B. The crossover connections between impedance elements 301 can increase the stability and bandwidth of the AAMC so that isolation plates are optionally included or excluded in the AAMC.

Figure 6B:
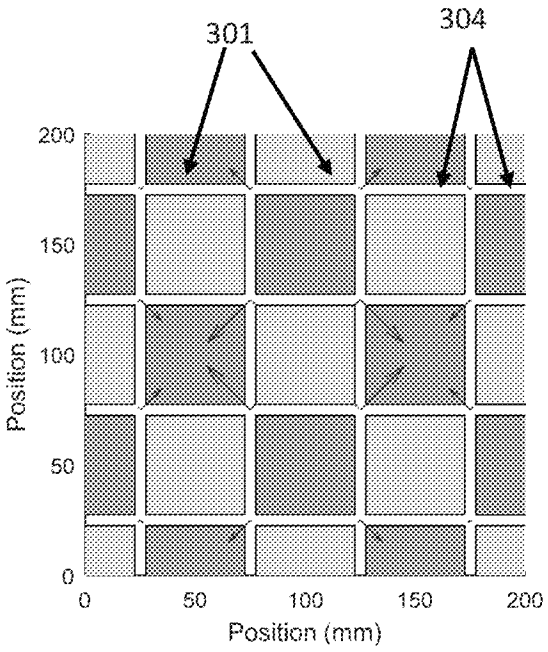
FIG. 6B illustrates an eigenmode analysis of the AAMC of FIGS. 3 and 5A-5C, according to an embodiment of the present disclosure.
Figure 6A:
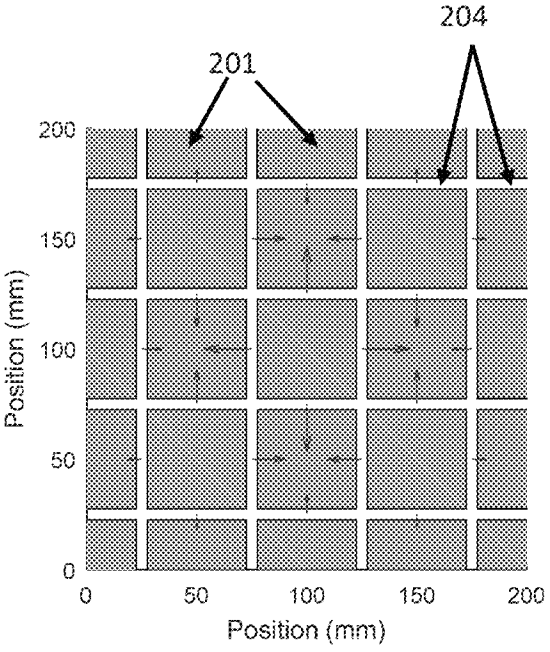
FIG. 6A illustrates an eigenmode analysis of the AAMC of FIGS. 2A and 2B.

FIGS. 6A and 6B illustrate simulation results of finite AAMC models. FIG. 6A illustrates results of an eigenmode analysis of the unit cell structure shown in FIGS. 2A and 2B. FIG. 6B illustrates the results of an eigenmode analysis of the crossover structure shown in FIGS. 3 and 5A-5C. In FIGS. 6A and 6B, the least stable mode is analyzed, with the normalized eigenmode voltages being shown with arrows. The eigenmode voltages are calculated by performing an eigendecomposition of the admittance matrix in Eq. 7 and the resulting eigenmodes are defined as eigenmode voltages. The lengths of the arrows indicate the magnitudes of the normalized eigenmode voltages, which are related to the magnitudes of the electric field. The directions of the arrows indicate the directions of the electric field that corresponds to the eigenmode voltages. A quadrupole mode exists as shown in FIG. 6A where each 2×2 section of patches has an alternating polarity on each patch. For the crossover structure, as seen in FIG. 6B, the darker patches and lighter patches are not connected to each other through the NFCs 302 (although they are connected to the same ground plane 305 by vias 303). As seen in the eigenmode plot of FIG. 6B, the least stable mode is excited only on the darker set of patches as there is almost no potential difference between the lighter patches. A similar stable mode is excited exclusively on the lighter patches of FIG. 6B. In FIG. 6B, the modes excited on the darker and lighter patches are each similar to the quadrupole mode excited in FIG. 6A, except that each mode is excited on only half of the total patches as compared with the standard NFC loading of FIG. 6A. The result is that the crossover structure of FIGS. 3 and 5A-5C is more stable for NFCs with lower inductances, allowing a broader AAMC bandwidth at a given frequency.

Stability can be verified by analyzing the eigenmodes of the AAMC structure and ensuring that each NFC 302 has a magnitude of inductance |L| greater than the maximum intrinsic eigenmode $L_{eq}$. The eigenmode inductances for a finite 6×6 AAMC structure, with NFCs 202 loaded between adjacent patches 201 as shown in FIGS. 2A and 2B, can lie in the range between 17-50 nH. The eigenmode inductance for a finite 6×6 AAMC having NFCs 302, with the crossover structure shown in FIGS. 3 and 5A-5C, can lie in the range between 35-70 nH. Therefore for stability, the inductance L of the NFCs must be less than −50 nH for the structure shown in FIGS. 2A and 2B and less than −70 nH for the crossover structures shown in FIGS. 3 and 5A-5C, though these stable inductance values are exemplary for the structures described above and can vary for other or similar structures, including those with different sizes and/or dimensions; the scope of the invention should not be limited to AAMC embodiments having these values. The NFCs (202 or 302) can be modeled using realistic parasitic capacitances and resistances. For example in at least one model, with the structure shown in FIGS. 2A and 2B, tuning the inductance L of the NFCs 202 from −50 nH to −80 nH can tune the AAMC center frequency from 489-665 MHz. In at least one model for the crossover structure shown in FIGS. 3 and 5A-5C, tuning L of the NFCs 302 from −70 nH to −120 nH can tune the AAMC center frequency from 223-612 MHz.

For the 6×6 AAMC, with the crossover structure shown in FIGS. 3 and 5A-5C, the percent bandwidth was measured to be above 100% near NFC 302 inductance L=−70 nH. The maximum percent bandwidth of the 6×6 AAMC, with the structure shown in FIGS. 2A and 2B, was measured to be around 50% at NFC 202 inductance L=−80 nH. Therefore, the maximum bandwidth of the crossover structure can be at least two times higher than that of the structure of FIGS. 2A and 2B. The increased bandwidth is achieved because the crossover structure can have a suppressed or restrained quadrupole mode and can operate stably with a higher $L_{AMC}$. For either structure, the center frequency can be lowered by coupling a capacitor/capacitance in parallel to the NFC 202 or 302 but this causes a reduction in bandwidth as described in equation (2). At center frequencies where both structures are stable, the crossover structure has slightly higher bandwidth due to a slightly reduced $C_{AMC}$ as compared with the bandwidth of the FIGS. 2A and 2B structure.

Figure 7:
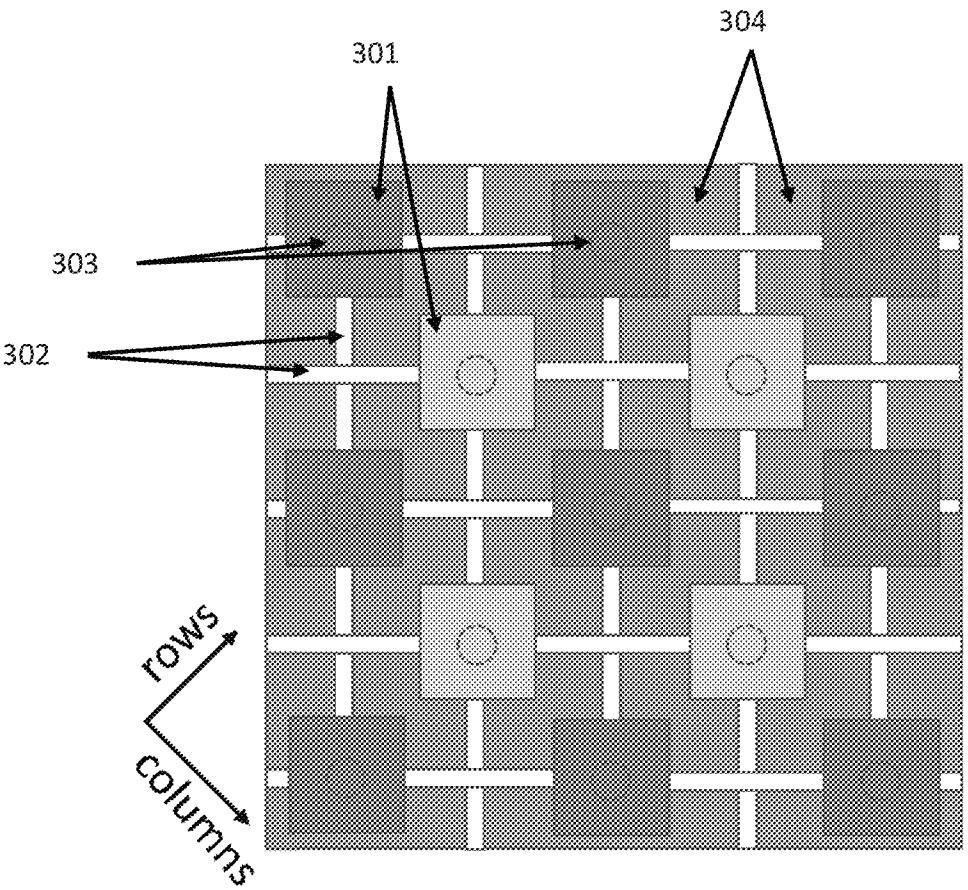
FIG. 7 illustrates a staggered arrangement of unit cells of a dual polarization AAMC.

FIG. 7 illustrates a staggered arrangement of unit cells of a dual polarization AAMC according to a further embodiment. This embodiment can be thought of as the embodiment depicted in FIGS. 3 and 5A-5C, with the impedance elements 301 rotated by a 45° angle. For the purposes of brevity, any description of the AAMC of FIG. 3 is incorporated into the description of the AAMC of FIG. 7. The NFCs 302 can be coupled at the sides of impedance elements 301 or they can be coupled at the centers of impedance elements 301. FIG. 7 shows the impedance elements 301 of the first network being interleaved with impedance elements 301 of the second network.

Figure 8:
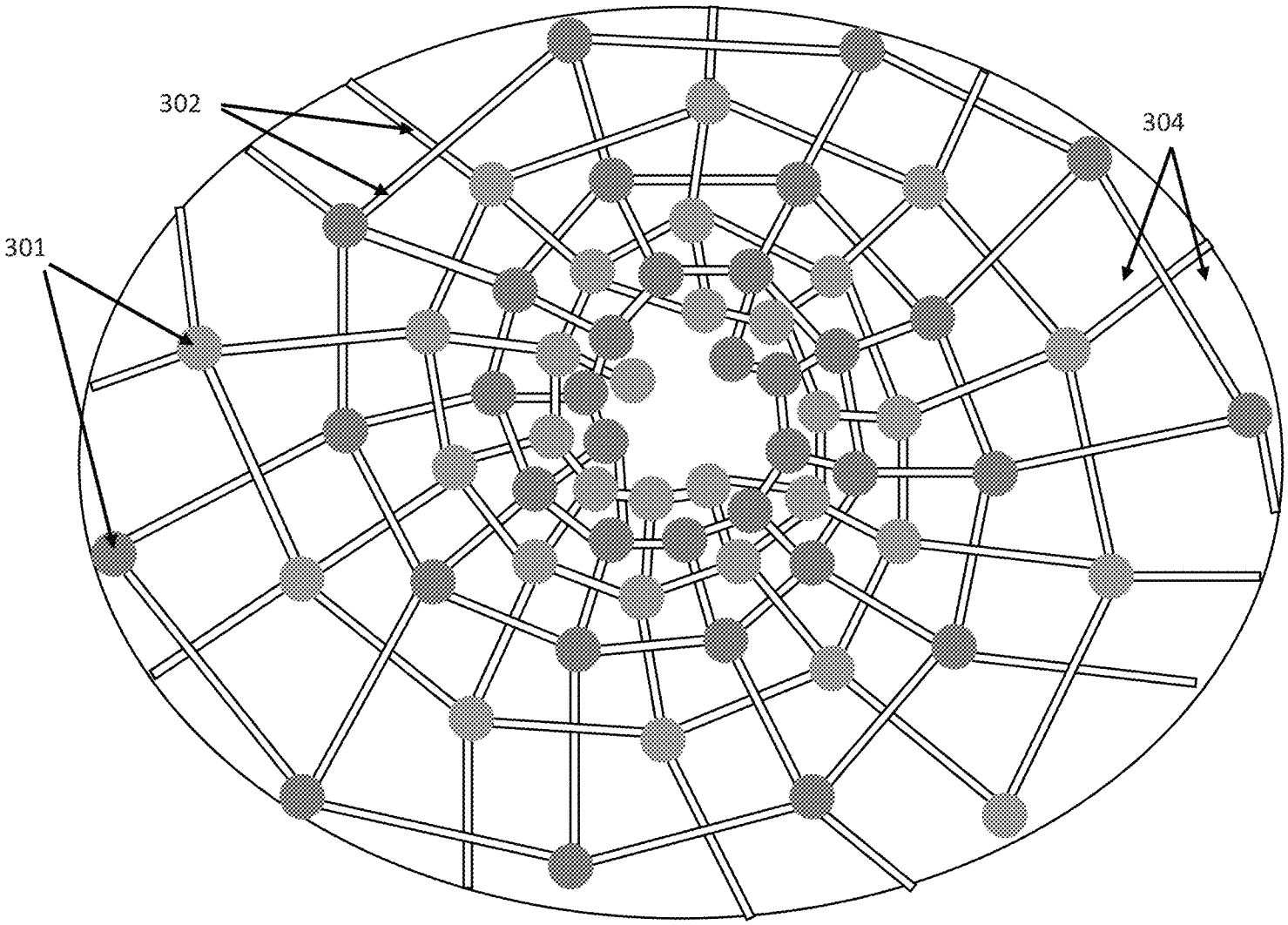
FIG. 8 illustrates a spiral lattice arrangement of unit cells of a dual polarization AAMC.

FIG. 8 illustrates a spiral lattice arrangement of unit cells of a dual polarization AAMC wherein impedance elements 301 form a spiral lattice arrangement. This embodiment is a rearrangement of the elements illustrated in FIG. 3. For the purposes of brevity, any description of the AAMC of FIG. 3 is incorporated into the description of FIG. 8. Low impedance shunts 303 and ground plane 305 are not shown in FIG.

8 but are included in the spiral lattice embodiment of the present technology. As in FIGS. 3 and 5A-5C, low impedance shunts 303 couple the impedance elements 301 to the ground plane 305. In FIG. 8, NFCs 302 are coupled between impedance elements 301 so as to form a first network of impedance elements 301 and NFCs 302 and a second network of impedance elements 301 and NFCs 302. The impedance elements 301 are shaded in FIG. 8 to indicate that the two networks of elements are interleaved along a surface of dielectric substrate 304.

The impedance elements 301 can be disposed in any suitable arrangement, including, but not limited to, a square lattice, a rectangular lattice, a triangular lattice, a spiral lattice, a hexagonal lattice, or any combination thereof. In addition, the impedance elements 301 can be separated by a distance that varies along the rows and/or columns of the array of impedance elements. The rows and/or columns of the array of impedance elements can be straight, spiral, or curvilinear.

The impedance elements 301 of the AAMC can comprise copper or any other conductive material. The thickness of the impedance elements 301 is preferably greater than the electromagnetic wave penetration depth, wherein the penetration depth is defined as the depth at which the intensity of the radiation inside the conductive patches 301 falls to 1/e of its original value at the surface of the conductive patch, where e is the base of the natural logarithm. The conductive patches 301 can be impenetrable to electromagnetic waves. The thickness of the conductive patches 301 can be thin compared to the unit cell dimension ($\text{thickness}_{patch}<\lambda/13$ in a preferred embodiment, wherein $\lambda$ is the wavelength of an incident wave). The AAMC can operate for any thickness in the range $0<\text{thickness}_{patch}<$unit cell size. A preferred method of manufacturing the AAMC can comprise etching copper with a standard thickness between 15 and 60 microns using printed circuit methods. Any metal manufacturing technique can be used: e.g. machining, pressing, forming, etching, electrodepositing, electroplating, or rolling metal. The bottom ground layer 305 can comprise a conductive sheet, which can comprise aluminum or any conductive material. Manufacturing methods used to form the impedance elements 301 can be used to form the ground layer 305. Circuits to power and bias the NFCs 302 can be placed under the ground plane, and signal traces for the bias circuits can be routed to each NFC 302 for example, through very small holes in the ground plane. In one embodiment, a multi-layer printed circuit board can be used to route signal traces to NFCs 302. The multi-layer printed circuit board can comprise a ground plane with holes/openings through which signal traces can be routed. Other layers in the multi-layer printed circuit board are used for signal trace routing.

In a preferred embodiment, the AAMC dielectric substrate 304 can comprise air so its relative permittivity is 1 or nearly 1. In this embodiment, the conductive patches 301 can be held in place by, for example, a thin insulating wire grid or a thin grid of substrate materials. Increasing the permittivity of the AAMC substrate 304 has a minor negative impact on the bandwidth of the AAMC. Increasing the permittivity increases the capacitance of the unloaded AAMC (note that $\text{bandwidth}=(1/Z_0)*\text{sqrt}(L_{AMC}/C_{AMC})$), though the value of $C_{AMC}$ is more determined by the capacitance of the NFC 302. Common microwave dielectrics have relative permittivity in the range of 1 to 10 ($\varepsilon$=1-10) but the AAMC structure can operate with any dielectric or dielectrics.

Most microwave materials have a permeability equal to 1 and can be included in a preferred embodiment. The first-order approximation of the substrate 304 inductance is $d\mu_r$ where d is the thickness of the substrate 304 and $\mu_r$ is the relative permeability of the substrate 304. Therefore the substrate 304 inductance is directly proportional to both the substrate 304 thickness and the relative permeability of the substrate 304. The AAMC can operate with any permeability.

The unit cell size in a preferred embodiment is 75 mm which is approximately $\lambda/13$ at a center frequency of 300 MHz. Using smaller unit cells reduces the capacitance $C_{AMC}$ of the AAMC and improves the bandwidth of the AAMC. However, using smaller unit cells requires more NFCs 302 per unit area of the AAMC, which increases manufacturing costs and operating power. The unit cell size can be less than $\lambda/2$ to operate as an AAMC. The substrate 304 thickness is 25 mm in a preferred embodiment, which is $\lambda/40$ at a center frequency of 300 MHz. The substrate 304 thickness preferably in the range between 0 to $\lambda/4$.

The AAMC preferably comprises a square array of impedance elements 301 because, for example, it provides an isotropic surface. The diagonal, crossover loading of the NFCs 302 can improve the stability and bandwidth of AAMCs having other lattice geometries including but not limited to: rectangular, anisotropic, radial, non-homogeneous lattices. The AAMC structure can also be conformal and/or curved in one or two dimensions. The edges of the AAMC structure can be terminated with metal walls in a preferred embodiment. These metal walls can couple the ground plane 305 to the impedance elements 301 located on the edges of the AAMC, and further couple these impedance elements 301 to one another. The structure can be terminated in other ways including but not limited to: a cavity shorted only to the ground plane 305 with full or half unit cells reaching the edge of the structure, a cavity with AAMC side walls, an electrically large ground plane, a finite ground plane, a cylindrical or spherical structure, any closed continuous structure, a curved but finite implementation of any of the previously listed terminations.

The methods of fabricating the AAMC can be apparent from FIGS. 3 and 5A-5C. Impedance elements 301 can be overlaid and/or deposited on a substrate 304 and can be coupled by NFCs 302 in a crossover configuration. A ground plane 305 is created by depositing a conductive metal layer at the bottom of the substrate 304. Vias 303 are used to shunt each patch to the ground plane 305 as shown. An optional protective coating can be applied to protect the active NFCs 302.

Though NFCs 302 are used, other structures are known in the art to provide the necessary negative inductances and/or negative capacitances. Similar crossover structures of the NFCs 302 can be extended to radial lattices/arrays and other topologies of unit cells, and other ways of interconnecting impedance elements. This disclosure is intended to cover all such variations in structure and topology.

In this writing, the term "neighboring" means "nearby" and does not necessarily imply a common boundary so that, for example, a first row and a second row are neighboring rows if they are separated by 0 or more rows. A "nearest neighbor" is a neighboring element that is the closest in proximity as compared to other neighboring elements. If several neighboring elements are equally closest to a first element, that first element has several nearest neighbors. In this writing, the term "adjacent" means "neighboring" and further implies a common boundary so that a first row is adjacent a second row only if a third row is not between the first and second row.

In this writing, the term "diagonally" means "along a diagonal direction" as compared to an axis with a traditional vertical y-axis and horizontal x-axis, wherein a diagonal direction can be defined with respect to the rows and columns in the array of impedance elements, as shown in FIGS. 3 and 7. Rows and columns define axial directions between neighboring or nearest neighboring impedance elements. Directions that are neither perpendicular nor parallel to these axial directions are diagonal directions. These diagonal directions are generally parallel to the plane defined by the axial directions. As shown in FIGS. 3 and 7, and as indicated by the shading of the impedance elements, the impedance elements alternate between the first and second networks along each of the rows and columns. A diagonal direction preferably forms an angle bisector of the angle formed by the axial directions, wherein the angle bisector divides the angle into two equal parts. Alternatively, the angle bisector can divide the angle into two non-equal parts.

In this writing, the word "conductive" preferably means "electrically conductive".

Modifications, additions, or omissions can be made to the systems, apparatuses, and methods described herein without departing from the scope of the invention. The components of the systems and apparatuses can be integrated or separated. Moreover, the operations of the systems and apparatuses can be performed by more, fewer, or other components. The methods can include more, fewer, or other steps. Additionally, steps can be performed in any suitable order. As used in this document, "each" refers to each member of a set or each member of a subset of a set.

Concepts

Concept 1. An artificial magnetic conductor comprising:

an array of impedance elements;

a plurality of non-Foster circuits coupled between neighboring impedance elements in the array of impedance elements so as to form a first network of impedance elements and non-Foster circuits and a second network of impedance elements and non-Foster circuits, wherein the impedance elements of the first network are interleaved between the impedance elements of the second network.

Concept 2. The artificial magnetic conductor of Concept 1, wherein the non-Foster circuits of the first network and the non-Foster circuits of the second network form crossover configurations.

Concept 3. The artificial magnetic conductor of Concept 1, wherein the impedance elements are arranged in a plurality of rows and columns, forming a rectangular or square lattice of impedance elements.

Concept 4. The artificial magnetic conductor of Concept 3, wherein columns of the plurality of rows and columns are staggered.

Concept 5. The artificial magnetic conductor of Concept 4, wherein the impedance elements arranged in the plurality of rows and staggered columns form a triangular lattice of impedance elements.

Concept 6. The artificial magnetic conductor of Concept 1, wherein the impedance elements are arranged to form a spiral lattice.

Concept 7. The artificial magnetic conductor of Concept 2, wherein each non-Foster circuit has a negative inductance; and wherein the impedance elements are square or rectangular in shape; and wherein the impedance elements are electrically conductive patches.

Concept 8. The artificial magnetic conductor of Concept 7, wherein the negative inductances of the non-Foster circuits are tunable.

Concept 9. The artificial magnetic conductor of Concept 7, wherein each non-Foster circuit has a negative capacitance.

Concept 10. The artificial magnetic conductor of Concept 7, wherein each non-Foster circuit comprises a negative inductor and a negative capacitor.

Concept 11. The artificial magnetic conductor of Concept 1, further comprising shunts;

a dielectric substrate; and a ground plane, wherein the impedance elements are disposed on the dielectric substrate, and wherein the shunts couple the impedance elements of the first and second networks to the ground plane, thereby coupling the first network of impedance elements and non-Foster circuits to the second network of impedance elements and non-Foster circuits.

Concept 12. The artificial magnetic conductor of Concept 11, wherein each shunt has an inductance that reduces the mutual coupling between the impedance elements.

Concept 13. The artificial magnetic conductor of Concept 11, wherein the impedance elements are metallic.

Concept 14. An active artificial magnetic conductor comprising:

a dielectric surface an array of unit cells, each unit cell comprising:

impedance elements arranged along the dielectric surface; and non-Foster circuits coupled between the impedance elements so as to form a first network of impedance elements and non-Foster circuits and a second network of impedance elements and non-Foster circuits within each unit cell;

wherein non-Foster circuits couple impedance elements between neighboring unit cells.

Concept 15. An artificial magnetic conductor comprising:

an array of impedance elements arranged along a surface;

a plurality of non-Foster circuits coupling said impedance elements to each other so as to form a first network of impedance elements and non-Foster circuits and a second network of impedance elements and non-Foster circuits;

wherein the first and second networks of impedance elements and non-Foster circuits are distinct, interleaved networks of impedance elements and non-Foster circuits.

Concept 16. The artificial magnetic conductor of Concept 15, wherein the non-Foster circuits of the first network are coupled between the impedance elements of the first network and the non-Foster circuits of the second network are coupled between the impedance elements of the second network.

Concept 17. The artificial magnetic conductor of Concept 16, wherein the non-Foster circuits of the first network are not coupled between the impedance elements of the second network.

Concept 18. The artificial magnetic conductor of Concept 17, wherein the non-Foster circuits of the second network are not coupled between the impedance elements of the first network.

Concept 19. The artificial magnetic conductor of Concept 15, wherein the impedance elements of the first network are interleaved between the impedance elements of the second network.

Concept 20. A broadband active artificial magnetic conductor comprising:

non-foster circuits;

conductive patches, wherein at least one non-foster circuit is connected to each conductive patch, the conductive patches each having edges, wherein the non-foster circuits connect to the edges of the patches.

Concept 21. The conductor of Concept 20 wherein the edges of each conductive patch form corners, the non-foster circuits connecting the conductive patches between corners.

Concept 22. The conductor of Concept 21 wherein the conductive patches are square or rectangular in shape.

Concept 23. The conductor of Concept 20 wherein the patches are grouped such that through the connections of the non-foster circuits, one group is interleaved with respect to the other group.

Concept 24. The conductor of Concept 20 further comprising a ground and vias, the vias connecting the patches to the ground.

Concept 25. The conductor of Concept 20 wherein the conductive patches have a thickness, the thickness being greater than the electromagnetic wave penetration depth of the conductive patches.

Concept 26. The conductor of Concept 1 wherein the array of impedance elements is arranged in rows and columns, the conductor further comprising a dielectric substrate on which the array is arranged, the array being arranged with a distance or gap positioned between adjacent impedance elements, wherein the non-foster circuits are arranged in the gaps to couple the neighboring impedance elements in a crossover configuration.

Concept 27. The conductor of Concept 26 wherein the non-foster circuits comprise at least one of negative inductors and negative capacitors, the negative inductors and negative capacitors being coupled in parallel between neighboring impedance elements.

Concept 28. The conductor of Concept 14 wherein the array of unit cells is periodic to reflect electromagnetic waves polarized parallel to the surface with a zero-degree phase.

Concept 29. The conductor of Concept 20, wherein the non-foster circuits couple diagonally neighboring conductive patches.

Concept 30. The artificial magnetic conductor of Concept 1, wherein the non-Foster circuits are diagonally connected between the impedance elements.

Concept 31. The active artificial magnetic conductor of Concept 14, wherein the non-Foster circuits are diagonally connected between the impedance elements within each unit cell.

Concept 32. The active artificial magnetic conductor of Concept 1, wherein the neighboring impedance elements have pairs of edges defining ports, wherein at frequencies below a resonant frequency, an admittance matrix of the active artificial magnetic conductor is approximated by:

$$Y \approx \frac{1}{s}\begin{pmatrix} \frac{1}{L_{11}} & \cdots & \frac{1}{L_{1N}} \\ \vdots & \ddots & \vdots \\ \frac{1}{L_{N1}} & \cdots & \frac{1}{L_{NN}} \end{pmatrix}$$

where N is the number of ports in the AAMC, $L_{ii}$ for i=1 to N is the self inductance of the ith port, $L_{ij}$ for i=1 to N, j=1 to N, and i≠j is the mutual inductance between the ith and jth ports, and s=j2πf is the complex radian frequency of the Laplace transform.

What is claimed is:

1. An artificial magnetic conductor comprising:

an array of impedance elements;

a plurality of non-Foster circuits coupled between neighboring impedance elements in the array of impedance elements so as to form a first network of impedance elements and non-Foster circuits and a second network of impedance elements and non-Foster circuits, wherein the impedance elements of the first network are interleaved between the impedance elements of the second network.

2. The artificial magnetic conductor of claim 1, wherein the non-Foster circuits of the first network and the non-Foster circuits of the second network form crossover configurations.

3. The artificial magnetic conductor of claim 2, wherein each non-Foster circuit has a negative inductance; and wherein the impedance elements are square or rectangular in shape; and wherein the impedance elements are electrically conductive patches.

4. The artificial magnetic conductor of claim 3, wherein the negative inductances of the non-Foster circuits are tunable.

5. The artificial magnetic conductor of claim 3, wherein each non-Foster circuit has a negative capacitance.

6. The artificial magnetic conductor of claim 3, wherein each non-Foster circuit comprises a negative inductor and a negative capacitor.

7. The artificial magnetic conductor of claim 1, wherein the impedance elements are arranged in a plurality of rows and columns, forming a rectangular or square lattice of impedance elements.

8. The artificial magnetic conductor of claim 7, wherein columns of the plurality of rows and columns are staggered.

9. The artificial magnetic conductor of claim 8, wherein the impedance elements arranged in the plurality of rows and staggered columns form a triangular lattice of impedance elements.

10. The artificial magnetic conductor of claim 1, wherein the impedance elements are arranged to form a spiral lattice.

11. The artificial magnetic conductor of claim 1, further comprising shunts;

a dielectric substrate; and a ground plane, wherein the impedance elements are disposed on the dielectric substrate, and wherein the shunts couple the impedance elements of the first and second networks to the ground plane, thereby coupling the first network of impedance elements and non-Foster circuits to the second network of impedance elements and non-Foster circuits.

12. The artificial magnetic conductor of claim 11, wherein each shunt has an inductance that reduces the mutual coupling between the impedance elements.

13. The artificial magnetic conductor of claim 11, wherein the impedance elements are metallic.

14. The conductor of claim 1 wherein the array of impedance elements is arranged in rows and columns, the conductor further comprising a dielectric substrate on which the array is arranged, the array being arranged with a distance or gap positioned between adjacent impedance elements, wherein the non-foster circuits are arranged in the gaps to couple the neighboring impedance elements in a crossover configuration.

15. The conductor of claim 14 wherein the non-foster circuits comprise at least one of negative inductors and negative capacitors, the negative inductors and negative capacitors being coupled in parallel between neighboring impedance elements.

16. The artificial magnetic conductor of claim 1, wherein the non-Foster circuits are diagonally connected between the impedance elements.

17. The artificial magnetic conductor of claim 1, wherein the neighboring impedance elements have pairs of edges defining ports, wherein at frequencies below a resonant frequency, an admittance matrix of the active artificial magnetic conductor is approximated by:

$$Y \approx \frac{1}{s}\begin{pmatrix} \frac{1}{L_{11}} & \cdots & \frac{1}{L_{1N}} \\ \vdots & \ddots & \vdots \\ \frac{1}{L_{N1}} & \cdots & \frac{1}{L_{NN}} \end{pmatrix}$$

where N is the number of ports in the AAMC, $L_{ii}$ for i=1 to N is the self inductance of the ith port, $L_{ij}$ for i=1 to N, j=1 to N, and i≠j is the mutual inductance between the ith and jth ports, and s=j2πf is the complex radian frequency of the Laplace transform.

18. An active artificial magnetic conductor comprising:

a dielectric surface an array of unit cells, each unit cell comprising:

impedance elements arranged along the dielectric surface; and non-Foster circuits coupled between the impedance elements so as to form a first network of impedance elements and non-Foster circuits and a second network of impedance elements and non-Foster circuits within each unit cell;

wherein non-Foster circuits couple impedance elements between neighboring unit cells.

19. The conductor of claim 18 wherein the array of unit cells is periodic to reflect electromagnetic waves polarized parallel to the surface with a zero-degree phase.

20. The active artificial magnetic conductor of claim 18, wherein the non-Foster circuits are diagonally connected between the impedance elements within each unit cell.

21. The active artificial magnetic conductor of claim 18, wherein the first and second networks of impedance elements and non-Foster circuits within each unit cell are distinct, interleaved networks of impedance elements and non-Foster circuits.

22. An artificial magnetic conductor comprising:

an array of impedance elements arranged along a surface;

a plurality of non-Foster circuits coupling said impedance elements to each other so as to form a first network of impedance elements and non-Foster circuits and a second network of impedance elements and non-Foster circuits;

wherein the first and second networks of impedance elements and non-Foster circuits are distinct, interleaved networks of impedance elements and non-Foster circuits.

23. The artificial magnetic conductor of claim 22, wherein the non-Foster circuits of the first network are coupled between the impedance elements of the first network and the non-Foster circuits of the second network are coupled between the impedance elements of the second network.

24. The artificial magnetic conductor of claim 23, wherein the non-Foster circuits of the first network are not coupled between the impedance elements of the second network.

25. The artificial magnetic conductor of claim 24, wherein the non-Foster circuits of the second network are not coupled between the impedance elements of the first network.

26. The artificial magnetic conductor of claim 22, wherein the impedance elements of the first network are interleaved between the impedance elements of the second network.

27. A broadband active artificial magnetic conductor comprising:

non-Foster circuits;

conductive patches, wherein at least one non-Foster is connected to each conductive patch, the conductive patches each having edges, wherein the non-Foster circuits connect to the edges of the patches so as to form a first network of patches and non-Foster circuits and a second network of patches and non-Foster circuits;

wherein the first and second networks of patches and non-Foster circuits are distinct, interleaved networks of patches and non-Foster circuits.

28. The conductor of claim 27 wherein the edges of each conductive patch form corners, the non-Foster circuits connecting the conductive patches between corners.

29. The conductor of claim 28 wherein the conductive patches are square or rectangular in shape.

30. The conductor of claim 27 wherein the patches are grouped such that through the connections of the non-Foster circuits, one group is interleaved with respect to the other group.

31. The conductor of claim 27 further comprising a ground and vias, the vias connecting the patches to the ground.

32. The conductor of claim 27 wherein the conductive patches have a thickness, the thickness being greater than the electromagnetic wave penetration depth of the conductive patches.

33. The conductor of claim 27, wherein the non-Foster circuits couple diagonally neighboring conductive patches.

* * * * *